US012331742B2

(12) United States Patent
Kim et al.

(10) Patent No.: US 12,331,742 B2
(45) Date of Patent: Jun. 17, 2025

(54) COMPRESSOR

(71) Applicant: LG Electronics Inc., Seoul (KR)

(72) Inventors: Taekyoung Kim, Seoul (KR); Kangwook Lee, Seoul (KR); Jungsun Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 91 days.

(21) Appl. No.: 17/920,639

(22) PCT Filed: Mar. 22, 2021

(86) PCT No.: PCT/KR2021/003468
§ 371 (c)(1),
(2) Date: Oct. 21, 2022

(87) PCT Pub. No.: WO2021/215674
PCT Pub. Date: Oct. 28, 2021

(65) Prior Publication Data

US 2023/0143495 A1 May 11, 2023

(30) Foreign Application Priority Data

Apr. 21, 2020 (KR) ..... 10-2020-0048034

(51) Int. Cl.
*F04C 18/02* (2006.01)
*F04C 29/02* (2006.01)
*F04C 29/12* (2006.01)

(52) U.S. Cl.
CPC ..... *F04C 18/0215* (2013.01); *F04C 29/021* (2013.01); *F04C 29/124* (2013.01)

(58) Field of Classification Search
CPC F04C 18/0215; F04C 2210/26; F04C 23/008; F04C 29/02; F04C 29/021;
(Continued)

(56) References Cited

U.S. PATENT DOCUMENTS

2008/0226483 A1* 9/2008 Iwanami ..... F01C 21/10 418/97
2016/0186754 A1* 6/2016 Cho ..... F04C 29/023 418/55.1
2017/0175743 A1* 6/2017 Dunn ..... F04C 23/008

FOREIGN PATENT DOCUMENTS

JP S58172401 10/1983
JP H 0615869 3/1994
(Continued)

OTHER PUBLICATIONS

International Search Report and Written Opinion in International Appln. No. PCT/KR2021/003468, dated Jun. 28, 2021, 15 pages (with English translation).

*Primary Examiner* — Anthony Ayala Delgado
(74) *Attorney, Agent, or Firm* — Fish & Richardson P.C.

(57) ABSTRACT

A compressor may comprise: a first fluid channel provided to communicate with an oil supply fluid channel so as to allow oil to flow therethrough; a second fluid channel provided to extend from the first fluid channel so as to allow the oil to flow to the outside of a case; a third fluid channel extending from the second fluid channel and provided outside the case; and a main fluid channel extending from the third fluid channel and provided through a fixed scroll or a main frame. Accordingly, the oil is supplied to a compression part by passing along the outside of the case, so that oil can be effectively supplied when a high-pressure operation is performed. Moreover, the present invention may not have a facility such as a pressure reduction pin, so that oil can be effectively supplied when a low-pressure operation is performed.

18 Claims, 9 Drawing Sheets

(58) Field of Classification Search
CPC ..... F04C 29/023; F04C 29/12; F04C 29/124; F04C 2240/20; F04C 2240/30; F04C 2240/809
See application file for complete search history.

(56) References Cited

FOREIGN PATENT DOCUMENTS

| | | |
|---|---|---|
| JP | 2017-223199 | 12/2017 |
| JP | 2018-193869 | 12/2018 |
| KR | 20180136282 | 12/2018 |

* cited by examiner (a)

COMPRESSOR

CROSS-REFERENCE TO RELATED APPLICATIONS

This application is a National Stage application under 35 U.S.C. § 371 of International Application No. PCT/KR2021/003468, filed on Mar. 22, 2021, which claims the benefit of Korean Application No. 10-2020-0048034, filed on Apr. 21, 2020. The disclosures of the prior applications are incorporated by reference in their entirety.

TECHNICAL FIELD

The present disclosure relates to a compressor. More specifically, the present disclosure relates to a scroll compressor in which an external oil supply structure is applied such that oil may be efficiently supplied.

BACKGROUND ART

In general, a compressor, as a device applied to a refrigeration cycle (hereinafter, abbreviated as the refrigeration cycle) such as a refrigerator or an air conditioner, is a device that compresses a refrigerant so as to perform an operation necessary for a heat exchange to occur in the refrigeration cycle.

The compressors may be divided into a reciprocating compressor, a rotary compressor, a scroll compressor, and the like based on a scheme of compressing the refrigerant. Among them, the scroll compressor is a compressor that forms a compression chamber between a fixed wrap of a fixed scroll and an orbiting wrap of an orbiting scroll as the orbiting scroll is engaged with and orbits the fixed scroll fixed in an inner space of a sealed container.

Because the scroll compressor is continuously compressed via shapes of scrolls in engagement with each other, the scroll compressor may obtain a relatively high compression ratio compared to other types of compressors. In addition, because suction, compression, and discharge strokes of the refrigerant are smooth, the scroll compressor may obtain a stable torque. For this reason, the scroll compressor is widely used for refrigerant compression in the air conditioner and the like.

Referring to Japanese Patent No. 6344452, a conventional scroll compressor includes a casing that forms an outer appearance of the compressor and has a discharge port through which a refrigerant is discharged, compressing portion fixed to the casing so as to compress the refrigerant, and a driver fixed to the casing and driving the compressing portion, and the compressing portion and the driver are connected to each other by a rotating shaft coupled to the driver and rotating.

The compressing portion includes a fixed scroll fixed to the casing and having a fixed wrap, and an orbiting scroll including an orbiting wrap driven in engagement with the fixed wrap by the rotating shaft. In such conventional scroll compressor, the rotating shaft is eccentric and the orbiting scroll rotates by being fixed to the eccentric rotating shaft. Therefore, the orbiting scroll compresses the refrigerant while orbiting along the fixed scroll.

In such a conventional scroll compressor, it is common that the compressing portion is disposed below the discharge port and the driver is disposed below the compressing portion. One end of the rotating shaft is coupled to the compressing portion, and the other end thereof extends through the driver.

In the conventional scroll compressor, because the compressing portion is disposed above the driver and is disposed close to the discharge port, it was difficult to supply oil to the compressing portion. In addition, there was a disadvantage that a lower frame is additionally needed to separately support the rotating shaft connected to the compressing portion from a position below the driver. In addition, the conventional scroll compressor had a problem in that an efficiency and a reliability are lowered as the scroll tilts because action points of a gas force generated by the refrigerant inside the compressor and a reaction force supporting the same do not coincide with each other.

In order to solve such problem, referring to Korean Patent Application Publication No. 10-2018-0124636, recently, a scroll compressor in which the driver is located below the discharge port and the compressing portion is located below the driver has appeared (as known as a lower scroll compressor).

In the lower scroll compressor, the driver is closer to the discharge port than the compressing portion, and the compressing portion is disposed farthest apart from the discharge port.

In such lower scroll compressor, one end of the rotating shaft may be connected to the driver and the other end thereof may be supported by the compressing portion, so that the lower frame may be omitted, and the oil stored in the lower portion of the casing lower may be directly supplied to the compressing portion without passing through the driver. In addition, when the rotating shaft extends through and is connected to the compressing portion in the lower scroll compressor, the action points of the gas force and the reaction force may coincide with each other on the rotating shaft to offset the vibration or the overturning moment of the scroll, thereby ensuring efficiency and reliability.

In one example, Patent Document 1 discloses a propeller and an oil pickup of a sealed compressor. The oil stored in the lower portion may be supplied using a centrifugal force. However, a structure in which a portion of an oil supply passage is disposed outside the compressor is not disclosed. Therefore, there is a problem that the oil is not able to be optimally supplied based on conditions of the compressor.

Patent Document 2 discloses a differential pressure oil supply structure and a pressure reducing pin in the lower scroll compressor. The oil stored in the lower portion may be supplied using a differential pressure. However, the structure in which the portion of the oil supply passage is disposed outside the compressor is not disclosed. Therefore, there is the problem that the oil is not able to be optimally supplied based on the conditions of the compressor.

DISCLOSURE

Technical Problem

According to the present embodiment, the present disclosure is to provide a compressor in which a portion of a passage to which oil is supplied is disposed outside such that the oil may be efficiently supplied.

In addition, the present disclosure is to provide a compressor that may adjust an amount of oil flowing in a passage to which the oil is supplied based on an operating pressure.

In addition, the present disclosure is to provide a compressor that may identify a line clogging phenomenon of a passage to which oil is supplied.

In addition, the present disclosure is to provide a compressor that may efficiently supply oil even when a line clogging phenomenon occurs in a passage to which oil is supplied.

In addition, the present disclosure is to provide a compressor in which a portion to which oil is supplied varies based on an operating pressure.

In addition, the present disclosure is to provide a compressor that may change a passage to which oil is supplied based on an operating pressure.

Technical Solutions

As an example for solving the above problems, it is to provide a compressor in which a portion of an oil supply passage extends to the outside of a casing, so that oil is supplied to compressing portion via the outside of the casing. In addition, it is to provide a compressor in which a plurality of passages through which the oil is supplied from the outside to the compressing portion or a suction port are arranged. In addition, it is to provide a compressor having a flow rate adjusting valve, a pressure sensor, and passage adjusting portion.

Specifically, according to the present embodiments, a compressor may include a casing having a suction port for a refrigerant to be introduced into the compressor, a discharge port for discharging the refrigerant, and a storage space for storing oil therein, a driver coupled to an inner circumferential surface of the casing, a rotating shaft coupled to the driver and rotating and constructed to supply the oil, and compressing portion coupled to the rotating shaft to compress the refrigerant and lubricated with the oil.

The compressing portion may include an orbiting scroll coupled to the rotating shaft to perform an orbital motion when the rotating shaft rotates, a fixed scroll disposed in engagement with the orbiting scroll, wherein the fixed scroll receives the refrigerant and compresses and discharges the refrigerant, and a main frame including a main end plate for accommodating the orbiting scroll therein and a main side plate connected to the fixed scroll.

The rotating shaft may include an oil feeder for collecting the oil stored in the oil storage space by extending through the fixed scroll, and an oil supply passage extending along a longitudinal direction of the rotating shaft to transfer the oil supplied from the oil feeder.

It is to provide a compressor including a first passage in communication with the oil supply passage so as to allow the oil to flow, a second passage extending from the first passage and constructed such that the oil is able to flow outside of the casing, a third passage extending from the second passage and disposed outside the casing, and a main passage extending from the third passage and extending through the fixed scroll or the main frame.

In addition, it is to provide a compressor in which the fixed scroll includes a fixed end plate disposed on a side of the main end plate far from the driver and coupled to the casing to form the other surface of the compressing portion, a fixed side plate extending from the fixed end plate toward the discharge port and in contact with the main side plate, and a fixed wrap positioned closer to the rotating shaft than the fixed side plate and protruding in a direction of the discharge port from the fixed end plate, wherein the fixed wrap forms a compression chamber where the refrigerant is compressed, wherein one of the main side plate, the fixed end plate, and the fixed side plate includes a first inflow portion extending through one of the main side plate, the fixed end plate, and the fixed side plate such that the oil is supplied to a space between the fixed scroll and the orbiting scroll from the main passage.

In addition, it is to provide a compressor including a second inflow portion positioned farther from the rotating shaft than the first inflow portion and extending through one of the main side plate, the fixed end plate, and the fixed side plate, and a first branched passage branched from the main passage and constructed such that the oil is supplied to the space between the fixed scroll and the orbiting scroll via the second inflow portion.

In addition, it is to provide a compressor in which the first inflow portion and the second inflow portion are disposed on opposite sides with respect to the rotating shaft.

In addition, it is to provide a compressor including a second branched passage branched from the main passage and constructed such that the oil is supplied to the suction port located farther from the rotating shaft than the first inflow portion.

In addition, it is to provide a compressor including passage adjusting portion disposed in a portion branching from the main passage to the first branched passage to change a passage such that the oil flows to the main passage or the first branched passage based on an operating pressure.

In addition, it is to provide a compressor in which the passage adjusting portion is disposed outside the casing.

In addition, it is to provide a compressor in which the passage adjusting portion is constructed to allow the oil to flow to the main passage when the operating pressure is equal to or higher than a reference value and to allow the oil to flow to the first branched passage when the operating pressure is lower than the reference value.

In addition, it is to provide a compressor in which the passage adjusting portion is formed as a three-way valve.

In addition, it is to provide a compressor including passage adjusting portion disposed in a portion branching from the main passage to the second branched passage to change a passage such that the oil flows to the main passage or the second branched passage based on an operating pressure.

In addition, it is to provide a compressor in which the passage adjusting portion is disposed outside the casing.

In addition, it is to provide a compressor in which the passage adjusting portion is constructed to allow the oil to flow to the main passage when the operating pressure is equal to or higher than a reference value and to allow the oil to flow to the second branched passage when the operating pressure is lower than the reference value.

In addition, it is to provide a compressor in which the passage adjusting portion is formed as a three-way valve.

In addition, it is to provide a compressor in which the second passage extends through the rotating shaft, the main end plate, and the casing.

In addition, it is to provide a compressor including a flow rate adjusting valve disposed on the third passage or the main passage, wherein an opening and closing rate of the flow rate adjusting valve is adjusted based on an amount of oil flowing into the third passage or the main passage.

In addition, it is to provide a compressor including a pressure sensor located rearwardly of the flow rate adjusting valve and in communication with the third passage or the main passage, wherein the pressure sensor measures a pressure of the third passage or the main passage.

In addition, it is to provide a compressor in which the flow rate adjusting valve is disposed outside the casing.

In addition, it is to provide a compressor in which the pressure sensor is disposed outside the casing.

Advantageous Effects

According to the embodiments of the present disclosure, the portion of the oil passage may be disposed outside of the compressor, so that the oil may be efficiently supplied to the rotating shaft and the compressing portion when the operating pressure is the high-pressure.

In addition, the plurality of passages to which the oil is supplied may be arranged to increase the oil supply efficiency.

In addition, the oil supply efficiency may be maximized as the passage through which the oil is supplied may be changed based on the operating pressure.

In addition, as the flow rate adjusting valve is disposed, the optimum amount of oil required for each condition based on the operating speed, the operating pressure, and the like may be supplied.

In addition, as the pressure sensor is disposed, the clogging of the oil passage may be identified, and accordingly, the opening and closing rate of the valve may be adjusted to secure the reliability of the passage.

In addition, when the oil passage clogging occurs, the oil may be supplied by changing the passage to which the oil is supplied, thereby securing the reliability of the passage.

BEST MODE

Hereinafter, a specific embodiment of the present disclosure will be described with reference to the drawings. Following detailed description is provided to provide a comprehensive understanding of a method, an apparatus, and/or a system described herein. However, this is merely an example and the present disclosure is not limited thereto.

In describing embodiments of the present disclosure, when it is determined that a detailed description of a known technology related to the present disclosure may unnecessarily obscure the gist of the present disclosure, the detailed description will be omitted. In addition, terms to be described later, as terms defined in consideration of functions thereof in the present disclosure, may vary based on intentions of users and operators or customs. Therefore, the definition thereof should be made based on the content throughout this specification. Terms used in the detailed description are for illustrating the embodiments of the present disclosure only, and should not be restrictive. Unless explicitly used otherwise, the singular expression includes the plural expression. Herein, expressions such as "comprising" or "including" are intended to indicate certain features, numbers, steps, operations, elements, and some or combinations thereof, and should not be construed to exclude a presence or a possibility of one or more other features, numbers, steps, operations, elements, or some or combinations thereof other than those described.

Figure 1:
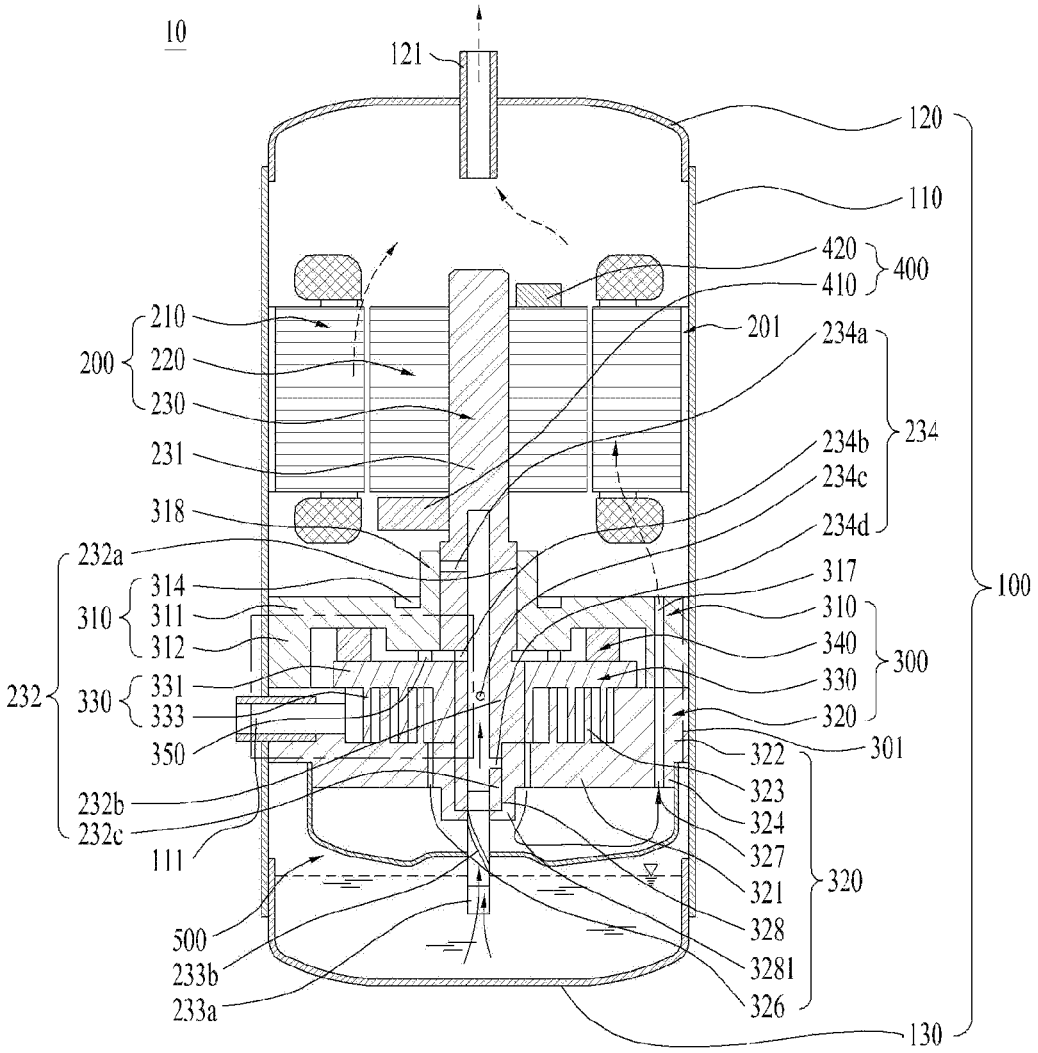
FIG. 1 is a view showing a basic configuration and an oil passage of a lower scroll compressor according to an embodiment of the present disclosure.

FIG. 1 shows a structure of a lower scroll compressor according to an embodiment of the present disclosure. Specifically, FIG. 1 shows an internal structure and an oil supply structure of a lower scroll compressor 10.

Referring to FIG. 1, a scroll compressor 10 may include a casing 100 having a space in which a fluid is stored or flows defined therein, a driver 200 coupled to an inner circumferential surface of the casing 100 to rotate a rotating shaft 230, and a compressing portion 300 disposed inside the casing and coupled to the rotating shaft 230 so as to compress the fluid.

Specifically, the casing 100 may have a discharge port 121 through which a refrigerant is discharged at one side thereof. The casing 100 may include an accommodating shell 110 formed in a cylindrical shape so as to accommodate the driver 200 and the compressing portion 300 therein, a discharge shell 120 coupled to one end of the accommodating shell 110 and equipped with the discharge port 121, and a blocking shell 130 coupled to the other end of the accommodating shell 110 so as to seal the accommodating shell 110. In addition, the casing 100 may include a suction port 111 through which the refrigerant is introduced at on one side of the accommodating shell 110.

The driver 200 may include a stator 210 for generating a rotating magnetic field, and a rotor 220 constructed to rotate by the rotating magnetic field, and the rotating shaft 230 may be coupled to the rotor 220 to rotate together with the rotor 220.

The stator 210 may have multiple slots defined along a circumferential direction in an inner circumferential surface thereof and a coil wound in the slots, and may be fixed to an inner circumferential surface of the accommodating shell 110. The rotor 220 may be coupled with a permanent magnet and disposed inside the stator 210 and rotatably coupled to the stator 210 so as to generate rotational power. The rotating shaft 230 may be press-fitted into a center of the rotor 220 and coupled to the rotor 220.

The compressing portion 300 may include a fixed scroll 320 coupled to the accommodating shell 110 and disposed on a side of the driver 200 far from the discharge port 121, an orbiting scroll 330 coupled to the rotating shaft 230 and engaged with the fixed scroll 320 so as to form a compression chamber, and a main frame 310 that accommodates the orbiting scroll 330 therein and is seated on the fixed scroll 320 to form an outer appearance of the compressing portion 300.

As a result, in the lower scroll compressor 10, the driver 200 is disposed between the discharge port 121 and the compressing portion 300. In other words, the driver 200 may be disposed on one side of the discharge port 121, and the compressing portion 300 may be disposed on the side of the driver 200 far from the discharge port 121. For example, when the discharge port 121 is disposed at an upper portion of the casing 100, the compressing portion 300 may be disposed at a lower portion of the driver 200, and the driver 200 may be disposed between the discharge port 121 and the compressing portion 300.

Accordingly, when oil is stored on a bottom surface of the casing 100, the oil may be directly supplied to the compressing portion 300 without passing through the driver 200. In addition, because the rotating shaft 230 is coupled to and supported by the compressing portion 300, a separate lower frame for rotatably supporting the rotating shaft separately may be omitted.

In one example, the lower scroll compressor 10 according to the present disclosure may be constructed such that the rotating shaft 230 passes through the orbiting scroll 330 as well as the fixed scroll 320 and is in surface contact with both the orbiting scroll 330 and the fixed scroll 320.

Therefore, an inflow force generated when the fluid such as the refrigerant flows into the compressing portion 300, a gas force generated when the refrigerant is compressed inside the compressing portion 300, and a reaction force supporting the same may act on the rotating shaft 230 as it is. Accordingly, the inflow force, the gas force, and the reaction force may be applied to one action point on the rotating shaft 230. Accordingly, because an overturning moment does not act on the orbiting scroll 330 coupled to the rotating shaft 230, the orbiting scroll may be fundamentally blocked from tilting or overturning. In other words, up to axial vibration of the vibration occurring in the orbiting scroll 330 may be attenuated or prevented, and the overturning moment of the orbiting scroll 330 may also be attenuated or suppressed. Therefore, noise and vibration generated by the lower scroll compressor 10 may be blocked.

In addition, because the fixed scroll 320 is in surface contact with and supports the rotating shaft 230, even when the input force and the gas force act on the rotating shaft 230, durability of the rotating shaft 230 may be reinforced.

In addition, the rotating shaft 230 may partially absorb a discharge pressure generated as the refrigerant is discharged to the outside, thereby reducing a force (a normal force) allowing the orbiting scroll 330 and the fixed scroll 320 to be in close contact with each other excessively in an axial direction. As a result, a friction force between the orbiting scroll 330 and the fixed scroll 320 may also be greatly reduced.

As a result, the compressor 10 may attenuate the shaking in the axial direction and the overturning moment of the orbiting scroll 330 inside the compressing portion 300, and reduce the friction force of the orbiting scroll, thereby improving an efficiency and a reliability of the compressing portion 300.

In one example, the main frame 310 of the compressing portion 300 may include a main end plate 311 disposed on one side of the driver 200 or at a lower portion of the driver 200, a main side plate 312 extending in a direction away from the driver 200 from an inner circumferential surface of the main end plate 311 and seated on the fixed scroll 320, and a main shaft accommodating portion 318 extending from the main end plate 311 so as to rotatably support the rotating shaft 230.

A main hole for guiding the refrigerant discharged from the fixed scroll 320 to the discharge port 121 may be further defined in the main end plate 311 or the main side plate 312.

The main end plate 311 may further include an oil pocket 314 defined in a concave shape outwardly of the main shaft accommodating portion 318. The oil pocket 314 may be defined in an annular shape, and may be defined so as to be eccentric from the main shaft accommodating portion 318. The oil pocket 314 may be defined such that, when the oil stored in the blocking shell 130 is transmitted via the rotating shaft 230 and the like, the oil may be supplied to a portion where the fixed scroll 320 and the orbiting scroll 330 are engaged with each other.

The fixed scroll 320 may include a fixed end plate 321 disposed on a side of the main end plate 311 far from the driver 200 and coupled to the accommodating shell 110 so as to form the other surface of the compressing portion 300, a fixed side plate 322 extending from the fixed end plate 321 toward the discharge port 121 and in contact with the main side plate 312, and a fixed wrap 323 disposed on an inner circumferential surface of the fixed side plate 322 so as to form the compression chamber in which the refrigerant is compressed.

In one example, the fixed scroll 320 may include a fixed through-hole 328 defined such that the rotating shaft 230 passes therethrough, and a fixed shaft accommodating portion 3281 extending from the fixed through-hole 328 so as to rotatably support the rotating shaft. The fixed shaft accommodating portion 3281 may be disposed at a center of the fixed end plate 321.

A thickness of the fixed end plate 321 may be equal to a thickness of the fixed shaft accommodating portion 3281. In this regard, the fixed shaft accommodating portion 3281 may not protrude and extend from the fixed end plate 321, but may be embedded in the fixed through-hole 328.

The fixed side plate 322 may have a suction hole 325 defined therein for introducing the refrigerant into the fixed wrap 323, and the fixed end plate 321 may have a discharge hole 326 defined therein for discharging the refrigerant. That is, the refrigerant may be introduced into the fixed wrap 323 via the suction port 111 and the suction hole 325. The discharge hole 326 may be defined at a center of the fixed wrap 323, but in order to avoid interference with the fixed shaft accommodating portion 3281, the discharge hole 326 may be defined to be spaced apart from the fixed shaft accommodating portion 3281 and may include a plurality of discharge holes.

The orbiting scroll 330 may include an orbiting end plate 331 disposed between the main frame 310 and the fixed scroll 320, and an orbiting wrap 333 forming the compression chamber together with the fixed wrap 323 on the orbiting end plate.

The orbiting scroll 330 may further include an orbiting through-hole 338 defined through the orbiting end plate 331 such that the rotating shaft 230 is rotatably coupled thereto.

The rotating shaft 230 may be constructed such that a portion thereof coupled to the orbiting through-hole 338 is eccentric. Accordingly, when the rotating shaft 230 rotates, the orbiting scroll 330 may move in engagement with the fixed wrap 323 of the fixed scroll 320 and may compress the refrigerant.

Specifically, the rotating shaft 230 may include a main shaft 231 coupled to the driver 200 and rotating, and a bearing portion 232 connected to the main shaft 231 and rotatably coupled to the compressing portion 300. The bearing portion 232 may be formed as a member separate from the main shaft 231 and may accommodate the main shaft 231 therein, or may be formed integrally with the main shaft 231.

The bearing portion 232 may include a main bearing portion 232*c* that is inserted into the main shaft accommodating portion 318 of the main frame 310 so as to be supported in a radial direction, a fixed bearing portion 232*a* that is inserted into the fixed shaft accommodating portion 3281 of the fixed scroll 320 so as to be supported in the radial direction, and an eccentric shaft 232*b* that is disposed between the main bearing portion 232*c* and the fixed bearing portion 232*a* and is inserted into the orbiting through-hole 338 of the orbiting scroll 330.

In this regard, the main bearing portion 232*c* and the fixed bearing portion 232*a* may be formed coaxially to have the same axis center, and the eccentric shaft 232*b* may be formed such that a center of gravity thereof is radially eccentric with respect to the main bearing portion 232*c* or the fixed bearing portion 232*a*. In addition, an outer diameter of the eccentric shaft 232*b* may be greater than an outer diameter of the main bearing portion 232*c* or an outer diameter of the fixed bearing portion 232*a*. Accordingly, the eccentric shaft 232*b* may provide a force to compress the refrigerant while allowing the orbiting scroll 330 to orbit when the rotating shaft 230 rotates, and the orbiting scroll 330 may orbit the fixed scroll 320 regularly by the eccentric shaft 232*b*.

In order to prevent the orbiting scroll 330 from rotating, the compressor 10 according to the present disclosure may further include an Oldham's ring 340 coupled to the orbiting scroll 330 from above. The Oldham's ring 340 may be disposed between the orbiting scroll 330 and the main frame 310 so as to be in contact with both the orbiting scroll 330 and the main frame 310. The Oldham's ring 340 is constructed to move linearly in four directions of a forward direction, a rearward direction, a leftward direction, and a rightward direction so as to prevent the rotation of the orbiting scroll 330.

In one example, the rotating shaft 230 may completely extend through the fixed scroll 320 and protrude outwardly of the compressing portion 300. Accordingly, a region outside of the compressing portion 300, the oil stored in the blocking shell 130, and the rotating shaft 230 may be in direct contact with each other, and the rotating shaft 230 may supply the oil into the compressing portion 300 while rotating.

The oil may be supplied to the compressing portion 300 via the rotating shaft 230. The oil supply passage 234 for supplying the oil to an outer circumferential surface of the main bearing portion 232*c*, an outer circumferential surface of the fixed bearing portion 232*a*, and an outer circumferential surface of the eccentric shaft 232*b* may be defined inside the rotating shaft 230.

In addition, a plurality of oil holes 234*a, b, c*, and *d* may be defined in the oil supply passage 234. Specifically, the oil holes may include a first oil hole 234*a*, a second oil hole 234*b*, a third oil hole 234*c*, and a fourth oil hole 234*d*. First, the first oil hole 234*a* may be defined to extend through the outer circumferential surface of the main bearing portion 232*c*.

In the oil supply passage 234, the first oil hole 234*a* may be defined to extend through the outer circumferential surface of the main bearing portion 232*c*. In addition, the first oil hole 234*a* may be defined, for example, to extend through an upper portion of the outer circumferential surface of the main bearing portion 232*c*, but the present disclosure may not be limited thereto. That is, the first oil hole 234*a* may be defined to extend through a lower portion of the outer circumferential surface of the main bearing portion 232*c*. For reference, the first oil hole 234*a* may include a plurality of holes, unlike the one illustrated in the drawing. In addition, when the first oil hole 234*a* include the plurality of holes, the hole may be defined only in the upper portion or the lower portion of the outer circumferential surface of the main bearing portion 232*c*, or the holes may be defined in the upper portion and the lower portion of the outer circumferential surface of the main bearing portion 232*c*, respectively.

In addition, the rotating shaft 230 may include an oil feeder 233 constructed to be in contact with the oil stored in the casing 100 through a muffler 500 to be described later. The oil feeder 233 may include an extension shaft 233*a* extending through the muffler 500 so as to be in contact with the oil, and a spiral groove 233*b* helically defined in an outer circumferential surface of the extension shaft 233*a* and in communication with the supply passage 234.

Accordingly, when the rotating shaft 230 rotates, because of the spiral groove 233*b*, a viscosity of the oil, and a pressure difference between a high-pressure region and an intermediate-pressure region inside the compressing portion 300, the oil ascends via the oil feeder 233 and the supply passage 234, and is discharged to the plurality of oil holes. The oil discharged via the plurality of oil holes 234*a*, 234*b*, 234*c*, and 234*d* may form an oil film between the fixed scroll 250 and the orbiting scroll 240 so as to maintain an airtight state, and absorb a frictional heat generated in a portion where the components of the compressing portion 300 rub against each other so as to dissipate the heat.

The oil guided along the rotating shaft 230 and supplied via the first oil hole 234*a* may lubricate the main frame 310 and the rotating shaft 230. In addition, the oil may be discharged via the second oil hole 234*b* and supplied to a top surface of the orbiting scroll 240, and the oil supplied to the top surface of the orbiting scroll 240 may be guided to an intermediate-pressure chamber via a pocket groove 314. For reference, the oil discharged through the first oil hole 234*a* or the third oil hole 234*d* as well as the second oil hole 234*b* may be supplied to the pocket groove 314.

In one example, the oil guided along the rotating shaft 230 may be supplied to the Oldham's ring 340 and the fixed side plate 322 of and the fixed scroll 320 installed between the orbiting scroll 240 and the main frame 310. Therefore, wear of the fixed side plate 322 of the fixed scroll 320 and the Oldham's ring 340 may be reduced. In addition, the oil supplied to the third oil hole 234*c* may be supplied to the compression chamber so as to not only reduce the wear caused by friction between the orbiting scroll 330 and the fixed scroll 320, but also improve a compression efficiency by forming the oil film and dissipating the heat.

A centrifugal oil supply structure in which the lower scroll compressor 10 supplies the oil to the bearing portion using the rotation of the rotating shaft 230 has been described, but this is only one embodiment. In one example, a differential pressure oil supply structure that supplies the oil using the pressure difference inside the compressing portion 300 and a forced oil supply structure that supplies the oil via a trochoid pump or the like may be applied.

In one example, the compressed refrigerant is discharged to the discharge hole 326 along a space defined by the fixed wrap 323 and the orbiting wrap 333. It may be more advantageous that the discharge hole 326 is defined to face the discharge port 121. This is because it is most advantageous for the refrigerant discharged from the discharge hole 326 to be delivered to the discharge port 121 without a significant change in a flow direction.

However, because of the structural characteristics that the compressing portion 300 is disposed on the side of the driver 200 far from the discharge port 121 and the fixed scroll 320 is disposed at an outermost portion of the compressing portion 300, the discharge hole 326 is defined to spray the refrigerant in a direction opposite to the discharge port 121.

In other words, the discharge hole 326 is defined to spray the refrigerant in a direction away from the discharge port 121 from the fixed end plate 321. Therefore, when the refrigerant is directly sprayed into the discharge hole 326, the refrigerant may not be smoothly discharged to the discharge port 121, and when the oil is stored in the blocking shell 130, there may be a fear that the refrigerant collides with the oil to be cooled or mixed with the oil.

To prevent such problem, the compressor 10 according to the present disclosure may further include the muffler 500 coupled to the fixed scroll 320 to provide a space for guiding the refrigerant to the discharge port 121.

The muffler 500 may be constructed to seal one surface of the fixed scroll 320 at a side far from the discharge port 121 so as to guide the refrigerant discharged from the fixed scroll 320 to the discharge port 121.

The muffler 500 may include a coupled body 520 coupled to the fixed scroll 320 and an accommodating body 510 extending from the coupled body 520 so as to define a closed space. Accordingly, the refrigerant sprayed from the discharge hole 326 may be discharged to the discharge port 121 by changing the flow direction along the closed space defined by the muffler 500.

In one example, because the fixed scroll 320 is coupled to the accommodating shell 110, the refrigerant may be restricted from flowing to the discharge port 121 by being interrupted by the fixed scroll 320. Accordingly, the fixed scroll 320 may further include a bypass hole 327 through which the refrigerant may pass through the fixed scroll 320 by passing through the fixed end plate 321. The bypass hole 327 may be defined to be in communication with the main hole 317. As a result, the refrigerant may pass through the compressing portion 300, then pass through the driver 200, and then be discharged through the discharge port 121.

In one example, the refrigerant is compressed with a higher pressure inwardly from the outer circumferential surface of the fixed wrap 323, so that regions inside the fixed wrap 323 and the orbiting wrap 333 maintain a high-pressure state. Therefore, the discharge pressure acts on a rear surface of the orbiting scroll as it is, and a back pressure acts from the orbiting scroll toward the fixed scroll as a reaction. The compressor 10 according to the present disclosure may further include a back pressure seal 350 that allows the back pressure to be concentrated in a portion where the orbiting scroll 330 and the rotating shaft 230 are coupled to each other so as to prevent leakage between the orbiting wrap 333 and the fixed wrap 323.

The back pressure seal 350 may be formed in a ring shape so as to maintain an inner circumferential surface thereof at a high-pressure and separate an outer circumferential surface thereof at an intermediate-pressure lower than the high-pressure. Therefore, the back pressure is concentrated on the inner circumferential surface of the back pressure seal 350, so that the orbiting scroll 330 is brought into close contact with the fixed scroll 320.

In consideration of the discharge hole 326 being spaced apart from the rotating shaft 230, the back pressure seal 350 may also be disposed such that a center thereof is biased toward the discharge hole 326. In one example, the oil supplied to the compressing portion 300 or the oil stored in the casing 100 may flow to the upper portion of the casing 100 together with the refrigerant as the refrigerant is discharged through the discharge port 121. In this regard, because the oil is denser than the refrigerant, the oil is not able to flow to the discharge port 121 by the centrifugal force generated by the rotor 220, and is attached to the inner walls of the discharge shell 120 and the accommodating shell 110. In the lower scroll compressor 10, the driver 200 and the compressing portion 300 may further include recovery passages on outer circumferential surfaces thereof so as to recover the oil attached to the inner wall of the casing 100 to the oil storage space of the casing 100 or the blocking shell 130, respectively.

The recovery passages may include a driver recovery passage 201 defined in the outer circumferential surface of the driver 200, a compressing portion recovery passage 301 defined in the outer circumferential surface of the compressing portion 300, and a muffler recovery passage 501 defined in the outer circumferential surface of the muffler 500.

The driver recovery passage 201 may be defined as a portion of an outer circumferential surface of the stator 210 is recessed, and the compressing portion recovery passage 301 may be defined as a portion of the outer circumferential surface of the fixed scroll 320 is recessed. In addition, the muffler recovery passage 501 may be defined as a portion of the outer circumferential surface of the muffler is recessed. The driver recovery passage 201, the compressing portion recovery passage 301, and the muffler recovery passage 501 may be in communication with each other to allow the oil to pass therethrough.

As described above, because the center of gravity of the rotating shaft 230 is biased to one side because of the eccentric shaft **232*b*, an unbalanced eccentric moment may occur during the rotation of the rotating shaft 230, and thus overall balance may be disturbed. Accordingly, the lower scroll compressor 10 according to the present disclosure may further include a balancer 400 capable of offsetting an eccentric moment that may occur by the eccentric shaft 232*b***.

Because the compressing portion 300 is fixed to the casing 100, the balancer 400 is preferably coupled to the rotating shaft 230 itself or the rotor 220 constructed to rotate. Therefore, the balancer 400 may include a center balancer 410 disposed on a lower end of the rotor 220 or one surface of the rotor 220 facing the compressing portion 300 so as to offset or reduce an eccentric load of the eccentric shaft **232*b*, and an outer balancer 420 coupled to an upper end of the rotor 220 or the other surface of the rotor 220 facing the discharge port 121 so as to offset an eccentric load or an eccentric moment of at least one of the eccentric shaft 232*b* and the lower balancer 420**.

Because the center balancer 410 is disposed relatively close to the eccentric shaft **232*b*, the center balancer 410 may directly offset the eccentric load of the eccentric shaft 232*b*. Therefore, it is preferable that the center balancer 410 is eccentric in a direction opposite to the eccentric shaft 232*b*. As a result, even when the rotating shaft 230 rotates at a low speed or a high speed, because a spaced distance from the eccentric shaft 232*b* is small, the center balancer 410 may effectively offset the eccentric force or the eccentric load generated from the eccentric shaft 232*b*** almost uniformly.

The outer balancer 420 may be eccentric in a direction opposite to the direction in which the eccentric shaft **232*b* is eccentric. However, the outer balancer 420 may be eccentric in a direction corresponding to the eccentric shaft 232***b* to partially offset the eccentric load generated by the center balancer 410.

Accordingly, the center balancer 410 and the outer balancer 420 may offset the eccentric moment generated by the eccentric shaft 232*b* to assist the rotating shaft 230 to rotate stably.

Figure 2:
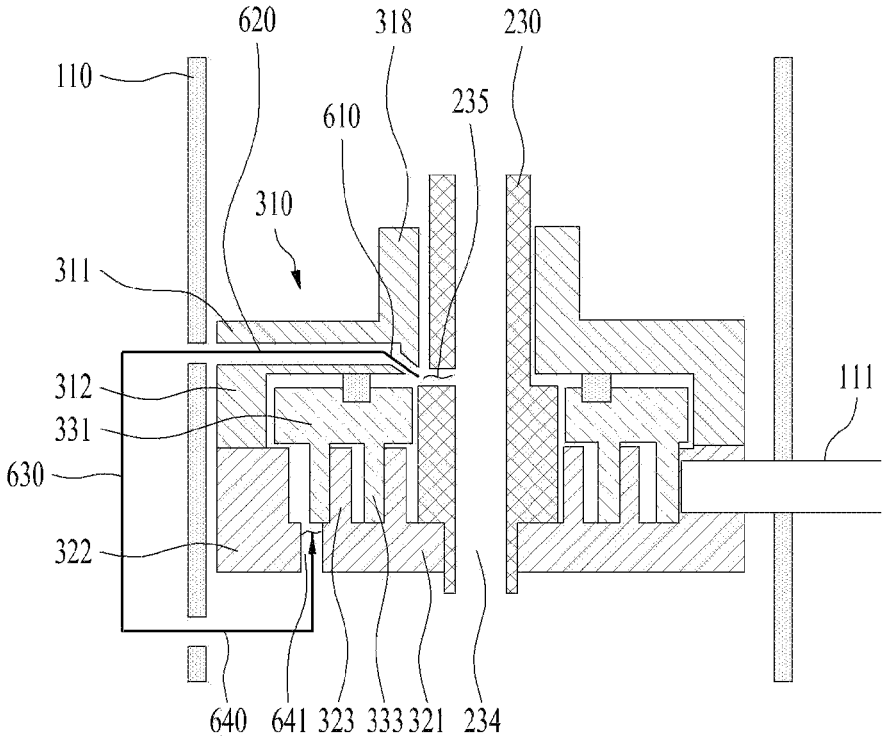
FIG. 2 is a view showing that a portion of an oil passage is disposed outside and a main passage is constructed such that oil may be supplied to a compressing portion, according to an embodiment of the present disclosure.

FIG. 2 is a view showing that a portion of an oil passage is disposed outside and a main passage is constructed such that oil may be supplied to compressing portion, according to an embodiment of the present disclosure.

The compressor 10 according to the present embodiment may have a first passage 610 in communication with the oil supply passage 234 such that the oil may flow.

Specifically, the first passage 610 may be in communication with the oil supply passage 234 via the plurality of oil holes 234*a*, 234*b*, 234*d*, and 234*e*. In addition, the first passage 610 may be in communication with the oil supply passage 234 via a separate rotating shaft through-hole 235 extending through the rotating shaft 230 in addition to the plurality of oil holes 234*a*, 234*b*, 234*d*, and 234*e*. In addition, a plurality of rotating shaft through-holes 235 may be defined in the rotating shaft.

The first passage 610 in communication with the oil supply passage 234 may extend through the main end plate. That is, the oil flowing through the oil supply passage 234 may pass through the plurality of oil holes 234*a*, 234*b*, 234*d*, and 234*e* and the rotating shaft through-hole 235 to flow into the first passage 610.

The first passage 610 may be disposed perpendicular to a longitudinal direction of the rotating shaft. In addition, the first passage 610 may be inclined toward a side surface of the casing 100 with respect to the longitudinal direction of the rotating shaft. Based on a structural rigidity of the main frame 310 and a position of the rotating shaft through-hole 235, a position and a shape of the first passage 610 may be freely selectable.

A second passage 620 may be constructed so as to extend from the first passage 610 and to allow the oil to flow to the outside of the casing 100.

That is, the main end plate 311 may include the second passage 620 extending therethrough. The second passage 620 may be disposed in the main end plate 311 and may extend from the first passage 610.

In addition, the second passage 620 may extend through the side surface of the casing 100. The oil flowing through the first passage 610 may flow out of the casing 100 via the second passage 620.

The second passage 620 may extend together with the first passage 610 by passing through the side surface of the casing 100 and the main end plate 311 in a straight line for convenience of manufacture and installation.

Accordingly, the first passage 610 and the second passage 620 may be disposed in the main end plate 311 and fixed in position while guiding the oil to the outside of the casing 100. That is, the oil may flow stably and structural stability of the first passage 610 and the second passage 620 may be secured inside the compressor 10, which is at high-temperature and high-pressure during operation.

The first passage 610 may mean a space defined inside the main end plate 311 and in which the oil flows. In addition, the first passage 610 may mean a pipe disposed inside the main end plate 311 and in communication with the rotating shaft through-hole 235. However, the first passage 610 is not interpreted as being limited thereto. It is sufficient when the first passage 610 is in communication with the oil supply passage 234 to serve to guide the oil, and a shape of the first passage 610 is not limited.

The second passage 620 may mean a space defined through the side surfaces of the main end plate 311 and the casing 100. That is, the second passage 620 may mean a space in which the oil that has passed through the first passage 610 flows. In addition, the second passage 620 may mean a pipe extending through the side surfaces of the main end plate and the casing 100. However, the second passage 620 is not interpreted as being limited thereto. It is sufficient when the second passage 620 extends from the first passage 610 to serve to guide the oil to the outside of the casing, and a shape of the second passage 620 is not limited.

That is, the first passage 610, which is the space defined through the main end plate 311 and in which the oil flows as described above, may be defined through the side surfaces of the main end plate 311 and the casing 100 and extend together with the second passage 620, which is a space in which the oil flows. The oil may be guided to the outside of the casing 100 without a separate device such as a pipe.

In addition, the first passage 610 may mean the space defined inside the main end plate 311 and in which the oil flows, and the second passage 620 may mean the pipe extending through the side surfaces of the main end plate 311 and the casing 100 and in which the oil flows.

Conversely, the first passage 610 may mean a pipe disposed inside the main end plate 311, extending through the main end plate 311, and in which the oil flows, and the second passage 620, as the space defined through the side surfaces of the main end plate 311 and the casing 100, may mean a space in which the oil flows and a space in which the oil that has passed through the first passage 610 flows.

A third passage 630 extending from the second passage 620 and disposed outside the casing 100 may be disposed.

That is, the third passage 630 may be formed as a pipe such that the oil supplied from the oil supply passage 234 and passed through the first passage 610 and the second passage 620 flows outside the casing 100. However, the third passage 630 is not interpreted as being limited thereto. It is sufficient when the third passage 630 extends from the second passage 620 such that the oil may flow outside the casing 100, and a shape of the third passage 630 is not limited.

A main passage 640 extending from the third passage 630 and extending through the fixed scroll 320 or the main frame 310 may be disposed.

The main passage 640 may extend from the third passage 630 and may extend into the casing 100 through the side surface of the casing 100. The main passage 640 may extend through a portion of the side surface of the casing 100 that is farther from the discharge port 121 than the second passage 620 is. This is for the convenience of installing the main passage 640 while supplying the oil to the space between the fixed scroll 320 and the orbiting scroll 330.

The main passage 640 extending into the casing 100 may supply the oil to the compressing portion 300 through the fixed scroll 320 or the main frame 310.

Specifically, a first inflow portion 641 may be disposed through one of the main side plate 312, the fixed end plate 321, and the fixed side plate 322. The main passage 640 may be disposed in the first inflow portion 641, so that the oil may be supplied to the space between the fixed scroll 320 and the orbiting scroll 330.

In other words, FIG. 2 shows that the first inflow portion 641 is disposed in the fixed end plate 321, but the position where the first inflow portion 641 is disposed is freely selectable as long as the oil is able to be supplied to the space between the fixed scroll and the orbiting scroll. That is, the first inflow portion 641 may be disposed in the main side plate 312 or the fixed side plate 322.

As the first inflow portion 641 is disposed in one of the fixed main side plate 312, the fixed end plate 321, and the fixed side plate 322, the oil may be stably supplied to the space between the fixed scroll 320 and the orbiting scroll 330 via the main passage 640.

As described above, from the oil supply passage 234, the oil may be supplied from the inside of the casing 100 to the compressing portion 300 via the outside of the casing 100 through the first passage 610, the second passage 620, the third passage 630, and the main passage 640.

Accordingly, efficiency reduction caused by a phenomenon in which the oil is excessively supplied when an operating pressure is a high-pressure may be prevented. In addition, because the compressor may not include a pressure reducing pin and the like therein, an oil supply amount insufficiency may be prevented even when the operating pressure is a low-pressure, thereby enabling efficient oil supply. In addition, because the passage through which the oil flows is disposed outside of the casing 100, repair and replacement may be easy when breakage or clogging of the passage occurs.

Figure 3:
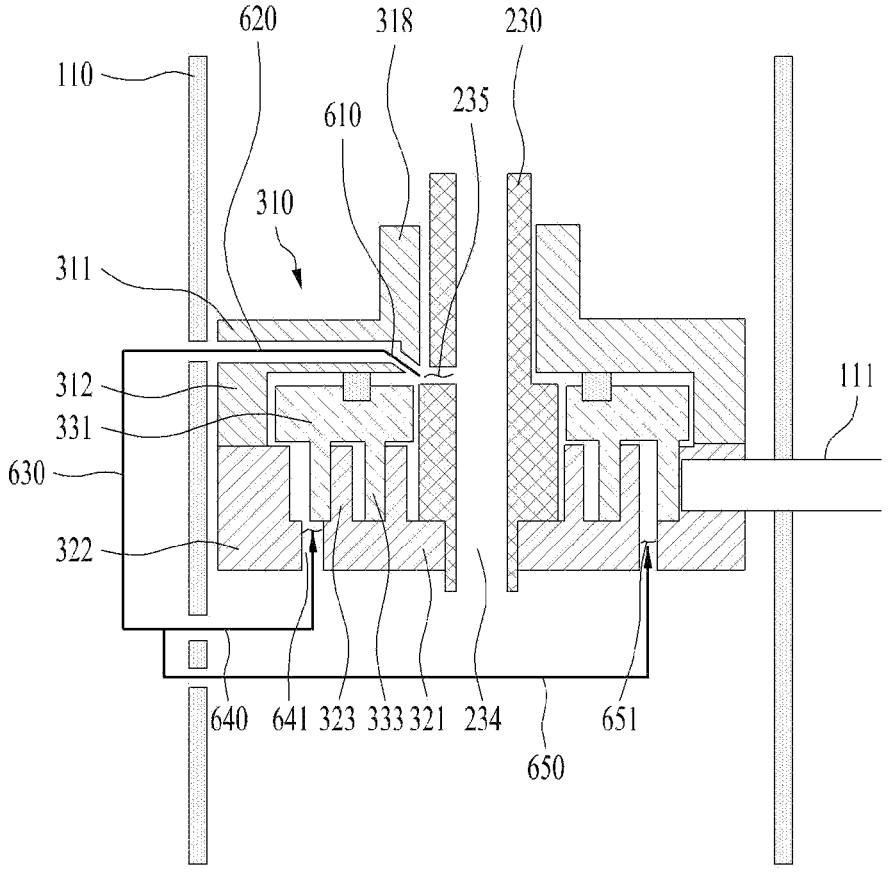
FIG. 3 is a view showing a first branched passage branched from a main passage according to an embodiment of the present disclosure.
Figure 4:
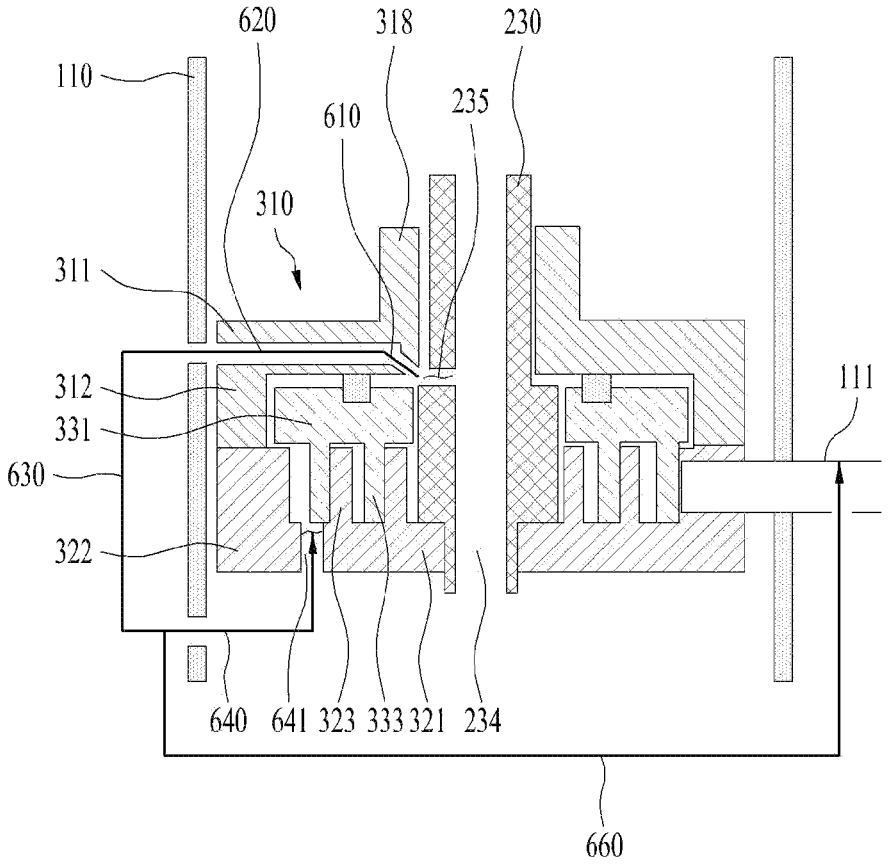
FIG. 4 is a view showing a second branched passage branched from a main passage according to an embodiment of the present disclosure.

FIG. 3 is a view showing a first branch passage branched from a main passage according to an embodiment of the present disclosure, and FIG. 4 is a view showing a second branch passage branched from a main passage according to an embodiment of the present disclosure.

Referring to FIG. 3, the compressor 10 according to the present embodiment may have a second inflow portion 651 in at least one of the main side plate 312, the fixed end plate 321, and the fixed side plate 322.

The second inflow portion 651 may be disposed to extend through the fixed end plate 321. The second inflow portion 651 may be located farther from the rotating shaft 230 than the first inflow portion 641.

Although not shown in the drawing, the position of the second inflow portion 651 is freely selectable as long as the oil is able to be supplied to the space between the fixed scroll and the orbiting scroll. That is, the second inflow portion 651 may be located farther from the rotating shaft 230 than the first inflow portion 641 and may extend through the fixed side plate 322 or the main side plate 312.

In addition, a first branched passage 650 may be constructed so as to be branched from the main passage 640 and to supply the oil via the second inflow portion 651. That is, the oil may be supplied to the second inflow portion 651 having a lower pressure than the first inflow portion 641.

Accordingly, the oil may be supplied to both sides via the main passage 640 and the first branched passage 650, thereby securing variety of passages. In addition, even when the clogging phenomenon occurs in one of the main passage 640 and the first branched passage 650, the oil may be smoothly supplied to the compressing portion 300, thereby preventing the damage to the compressor 10.

The first inflow portion 641 and the second inflow portion 651 may be disposed on the same side or on opposite sides with respect to the rotating shaft 230. However, for convenience of installation of the main passage 640 and the first branched passage 650 and efficient utilization of space, preferably, the first inflow portion and the second inflow portion 651 are disposed on the opposite sides with respect to the rotating shaft 230.

The first branched passage 650 may be branched from the main passage 640 from the outside of the casing 100. This is to efficiently utilize the inner space of the casing 100.

When the first branched passage 650 is branched from the main passage 640 from the outside of the casing 100, the first branched passage 650 may extend through the side surface of the casing 100. That is, the first branched passage 650 may be branched from the main passage 640 and extend into the casing 100 through the side surface of the casing 100.

In addition, the first branched passage 650 may extend through a portion of the side surface of the casing 100 located farther from the discharge port 121 than the second passage 620. This is for convenience of installation of the first branched passage 650 while supplying the oil to the space between the fixed scroll 320 and the orbiting scroll 330.

This is only an example. When a sufficient space is secured inside the casing 100, the first branched passage 650 may be branched from the main passage 640 inside the casing 100. In this case, the first branched passage 650 may not extend through the side surface of the casing 100.

Referring to FIG. 4, the compressor 10 according to the present embodiment may have a second branched passage 660 branched from the main passage 640. That is, the second branched passage 660 may be constructed such that the oil flows to the suction port 111 located farther from the rotating shaft 230 than the first inflow portion 641.

The first inflow portion 641 and the suction port 111 may be disposed on the same side or on opposite sides with respect to the rotating shaft 230. However, for convenience of installation of the main passage 640 and the second branched passage 660 and efficient utilization of space, preferably, the first inflow portion 641 and the suction port 111 are disposed on the opposite sides with respect to the rotating shaft 230.

The second branched passage 660 may be branched from the main passage 640 at a location outside of the casing 100. In addition, the second branched passage 660 may extend through the suction port 111 such that the oil may flow to the suction port 111. That is, the second branched passage 660 may extend directly to the suction port 111 at the location outside of the casing 100. Accordingly, the second branched passage 660 may allow the oil to flow to be supplied to the suction port 111 from the outside of the casing 100.

The oil that has passed through the third passage 630 may be supplied to the space between the fixed scroll 320 and the orbiting scroll 330 via the main passage 640. In addition, the oil that has passed through the third passage 630 may be supplied to the suction port 111 via the second branched passage 660.

Accordingly, the oil may be supplied to the both sides via the main passage 640 and the second branched passage 660, thereby securing the variety of passages. In addition, even when the clogging phenomenon occurs in one of the main passage 640 and the second branched passage 660, the oil may be smoothly supplied to the compressing portion 300, thereby preventing the damage to the compressor 10. In addition, the second branched passage may be located only outside the casing 100 without extending into the casing 100, so that installation, repair, and replacement thereof may be easy.

Figure 5:
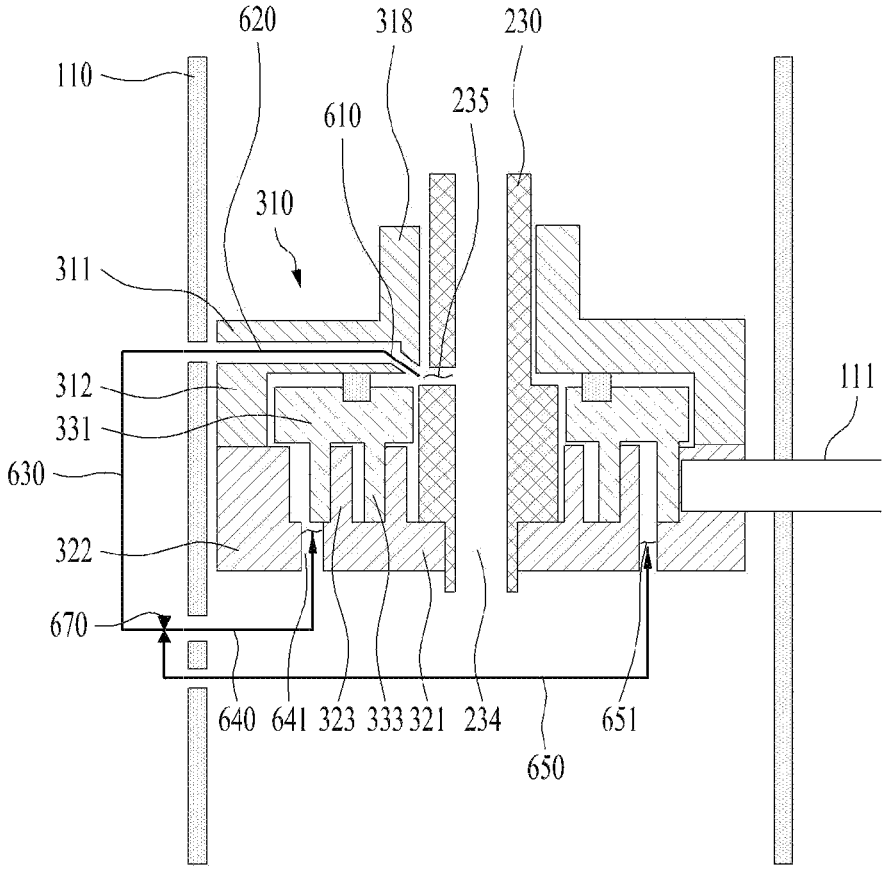
FIG. 5 is a view showing passage adjusting portion disposed between a main passage and a first branched passage and constructed such that a passage may be changed, according to an embodiment of the present disclosure.

FIG. 5 is a view showing passage adjusting portion disposed between the main passage and the first branched passage and constructed such that the passage is changeable, according to an embodiment of the present disclosure.

Hereinafter, FIG. 5 will be described. A description of the content duplicate with the content described in FIG. 3 will be omitted. However, not all of the same contents as those described above are omitted, and some may be described again for convenience of description and clear understanding of the invention. In addition, omissions should not be excluded or interpreted independently.

The compressor 10 according to the present embodiment may have passage adjusting portion 670 at a portion branching from the main passage 640 to the first branched passage 650.

The passage adjusting portion 670 may be formed as a three-way valve. In addition, although not shown in the drawing, the passage adjusting portion 670 may include a main valve disposed on the main passage 640 and a branched valve disposed on the first branched passage 650. The passage adjusting portion 670 may be appropriately selected in consideration of a space in which the compressor is installed, the operating pressure, an operating speed, an external environment, and the like.

When the passage adjusting portion 670 is formed as the three-way valve, the passage may be adjusted with one valve, so that installation may be easy and the installation space of the compressor 10 may be reduced.

The passage adjusting portion 670 may change the passage such that the oil flows into the main passage 640 or the first branched passage 650 based on the operating pressure.

That is, when the compressor 10 is operated at the high-pressure, the passage adjusting portion 670 may operate such that the oil may be supplied to the first inflow portion 641. Conversely, when the compressor 10 is operated at the low-pressure, the passage adjusting portion 670 may operate such that the oil may be supplied to the second inflow portion 651.

Specifically, the first inflow portion 641 is disposed closer to the rotating shaft than the second inflow portion 651. Therefore, a pressure of the first inflow portion 641 is greater than a pressure of the second inflow portion 651.

That is, when the compressor 10 is operated at the high-pressure, a difference between a pressure at which the oil is discharged from the oil supply passage 234 and the pressure of the second inflow portion 651 becomes greater than a pressure at which the oil may be efficiently supplied, so that the oil may be excessively supplied. Accordingly, it may cause a decrease in the efficiency of the compressor 10.

Conversely, when the compressor 10 is operated at the low-pressure, a difference between a pressure of the portion of the oil supply passage 234 from which the oil is discharged and the pressure of the first inflow portion 641 becomes smaller than the pressure at which the oil may be efficiently supplied, so that the oil may be under-supplied. Accordingly, it may cause the decrease in the efficiency of the compressor 10.

Accordingly, the passage adjusting portion 670 may be operated such that the oil is supplied to the main passage 640 or the first branched passage 650 based on the operating pressure, thereby improving the efficiency of the compressor 10.

A reference value at which the passage adjusting portion 670 is adjusted such that the oil is supplied from the main passage 640 to the first branched passage 650 is as follows.

That is, the reference value may be a pressure ratio Pr defined by dividing a pressure Pd of the portion of the oil supply passage 234 from which the oil is discharged by a pressure Ps of the suction port 111. Specifically, when the pressure ratio Pr is equal to or higher than 1.3, the passage adjusting portion 670 may be operated to allow the oil to flow to the main passage 640. In addition, when the pressure ratio Pr is lower than 1.3, the passage adjusting portion 670 may be operated to allow the oil to flow to the first branched passage 650.

The oil may be efficiently supplied to the space between the fixed scroll 320 and the orbiting scroll 330 by operating the passage adjusting portion 670 based on the reference value of the operating pressure.

Figure 6:
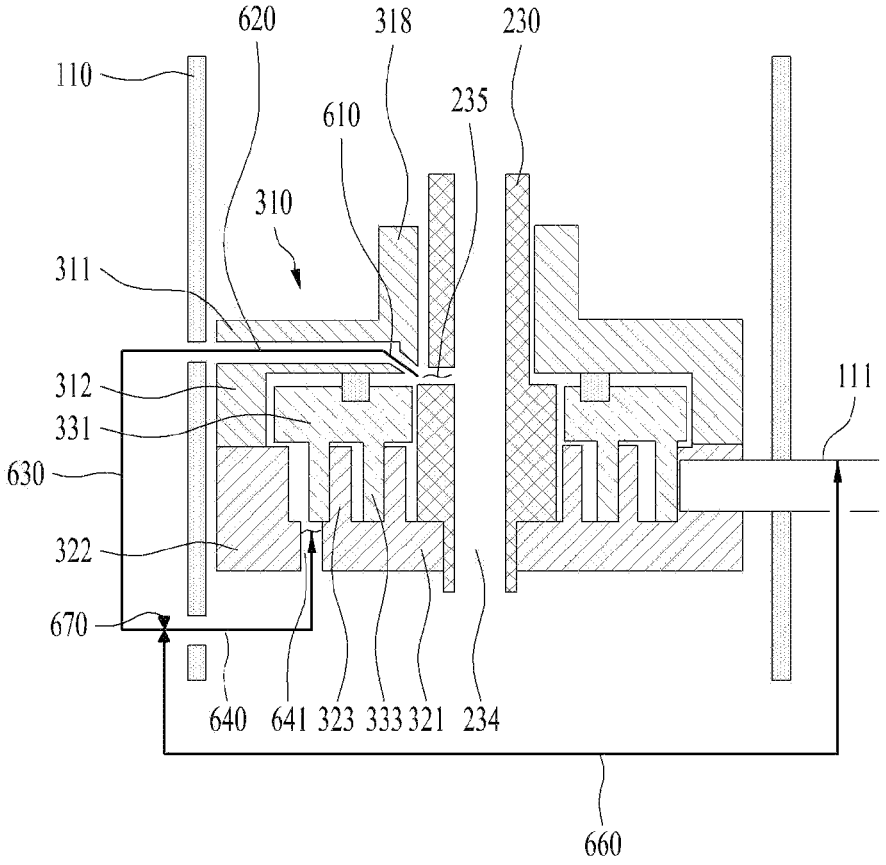
FIG. 6 is a view showing passage adjusting portion disposed between a main passage and a second branched passage and constructed such that a passage may be changed, according to an embodiment of the present disclosure.

FIG. 6 is a view showing passage adjusting portion disposed between a main passage and a second branched passage such that a passage is changeable, according to an embodiment of the present disclosure.

Hereinafter, FIG. 6 will be described. A description of the content duplicate with the content described in FIG. 4 will be omitted. However, not all of the same contents as those described above are omitted, and some may be described again for convenience of description and clear understanding of the invention. In addition, omissions should not be excluded or interpreted independently.

The compressor 10 according to the present embodiment may have the passage adjusting portion 670 at a portion branching from the main passage 640 to the second branched passage 660.

The passage adjusting portion 670 may be formed as the three-way valve. In addition, although not shown in the drawing, the passage adjusting portion 670 may include the main valve disposed on the main passage 640 and a branched valve disposed on the second branched passage 660. The passage adjusting portion 670 may be appropriately selected in consideration of the space in which the compressor is installed, the operating pressure, the operating speed, the external environment, and the like.

When the passage adjusting portion 670 is formed as the three-way valve, the passage may be adjusted with one valve, so that the installation may be easy and the installation space of the compressor 10 may be reduced.

The passage adjusting portion 670 may change the passage such that the oil flows into the main passage 640 or the second branched passage 660 based on the operating pressure.

That is, when the compressor 10 is operated at the high-pressure, the passage adjusting portion 670 may operate such that the oil may be supplied to the first inflow portion 641. Conversely, when the compressor 10 is operated at the low-pressure, the passage adjusting portion 670 may operate such that the oil may be supplied to the suction port 111.

Specifically, the first inflow portion 641 is disposed closer to the rotating shaft than the suction port 111. Therefore, a pressure of the first inflow portion 641 is greater than a pressure of the suction port 111.

That is, when the compressor 10 is operated at the high-pressure, a difference between the pressure at which the oil is discharged from the oil supply passage 234 and a pressure of the suction port 111 becomes greater than the pressure at which the oil may be efficiently supplied, so that the oil may be excessively supplied. Accordingly, it may cause the decrease in the efficiency of the compressor 10.

Conversely, when the compressor 10 is operated at the low-pressure, a difference between the pressure of the portion of the oil supply passage 234 from which the oil is discharged and the pressure of the first inflow portion 641 becomes smaller than the pressure at which the oil may be efficiently supplied, so that the oil may be under-supplied. Accordingly, it may cause the decrease in the efficiency of the compressor 10.

Accordingly, the passage adjusting portion 670 may be operated such that the oil is supplied to the main passage 640 or the second branched passage 660 based on the operating pressure, thereby improving the efficiency of the compressor 10.

A reference value at which the passage adjusting portion 670 is adjusted such that the oil is supplied from the main passage 640 to the second branched passage 660 is as follows.

That is, the reference value may be the pressure ratio Pr defined by dividing the pressure Pd of the portion of the oil supply passage 234 from which the oil is discharged by the pressure Ps of the suction port 111. Specifically, when the pressure ratio Pr is equal to or higher than 1.3, the passage adjusting portion 670 may be operated to allow the oil to flow to the main passage 640. In addition, when the pressure ratio Pr is lower than 1.3, the passage adjusting portion 670 may be operated to allow the oil to flow to the first branched passage 650.

The oil may be efficiently supplied to the space between the fixed scroll 320 and the orbiting scroll 330 by operating the passage adjusting portion 670 based on the reference value of the operating pressure.

Figure 7:
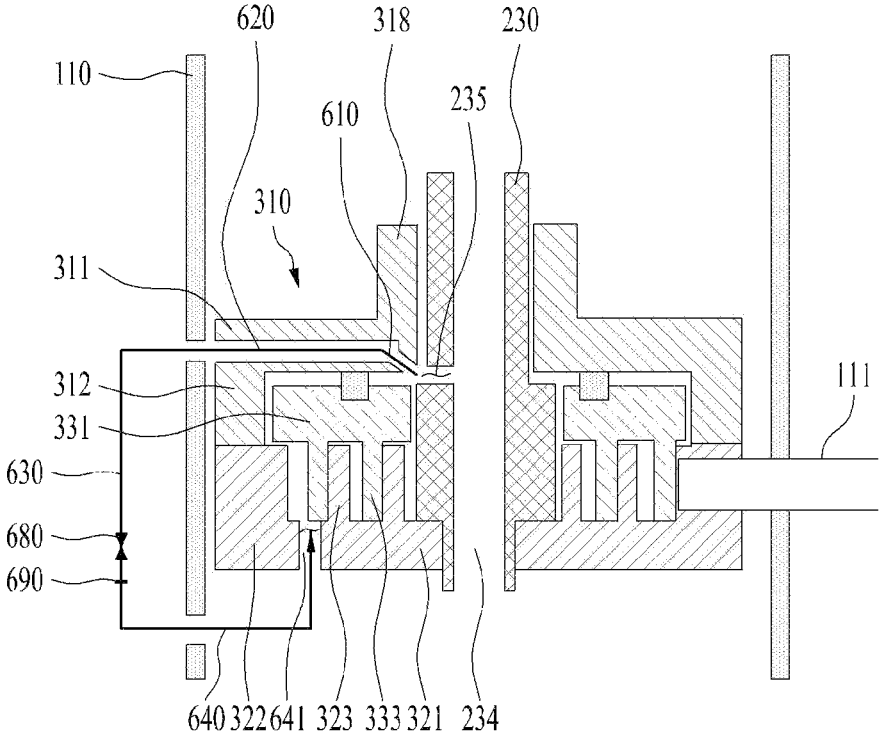
FIG. 7 is a view showing a flow rate adjusting valve and a pressure sensor according to an embodiment of the present disclosure.

FIG. 7 is a view showing a flow rate adjusting valve and a pressure sensor according to an embodiment of the present disclosure.

The compressor 10 according to the present embodiment may include a flow rate control valve 680 (also referred to herein as a flow rate adjusting valve) disposed on the third passage 630 or the main passage 640.

When the flow rate control valve 680 is disposed on the main passage 640, the flow rate control valve 680 may be installed outside the casing 100 for convenience of installation thereof and utilization of the inner space of the casing 100.

An opening and closing rate of the flow rate adjusting valve 680 may be adjusted based on an amount of oil flowing into the third passage 630 or the main passage 640.

Specifically, the flow rate adjusting valve 680 may be formed as an electric valve. The opening and closing rate may be electronically and automatically controlled based on the amount of oil flowing into the third passage 630 or the main passage 640.

That is, when the amount of oil flowing through the third passage 630 or the main passage 640 is great, the opening and closing rate of the flow rate adjusting valve 680 may be reduced to reduce the amount of oil flowing through the third passage 630 or the main passage 640. Conversely, when the amount of oil flowing through the third passage 630 or the main passage 640 is small, the opening and closing rate of the flow rate adjusting valve 680 may be increased to increase the amount of oil flowing through the third passage 630 or the main passage 640.

In other words, an amount of supplied to the space between the fixed scroll 320 and the orbiting scroll 330 via the third passage 630 and the main passage 640 may be maintained constant.

Accordingly, the efficiency of the oil supply may be maintained high. Furthermore, the efficiency of the compressor 10 may be improved. In addition, an optimum amount of oil required for each condition based on the operating speed, the operating pressure, and the like may be supplied to the space between the fixed scroll 320 and the orbiting scroll 330.

The compressor 10 according to the present embodiment may further include a pressure sensor 690 located rearwardly of the flow rate adjusting valve 680. The pressure sensor 690 may be in communication with the third passage 630 or the main passage 640. The pressure sensor 690 may measure the pressure of the third passage or the main passage 640. The pressure sensor 690 may be installed outside the casing 100 for convenience of installation thereof.

The pressure measured by the pressure sensor 690 may be utilized by the flow rate adjusting valve 680 in measuring the amount of oil flowing to the third passage 630 or the main passage 640.

In addition, the pressure measured by the pressure sensor 690 may identify the passage clogging phenomenon of the third passage 630 or the main passage 640. Furthermore, the clogging phenomenon of the flow rate adjusting valve 680 may be identified.

When the passage clogging phenomenon is identified by the pressure sensor 690, the flow rate adjusting valve 680 may be maximally opened to solve the passage clogging phenomenon. Accordingly, reliability of the oil supply of the compressor 10 may be secured.

Figure 8:
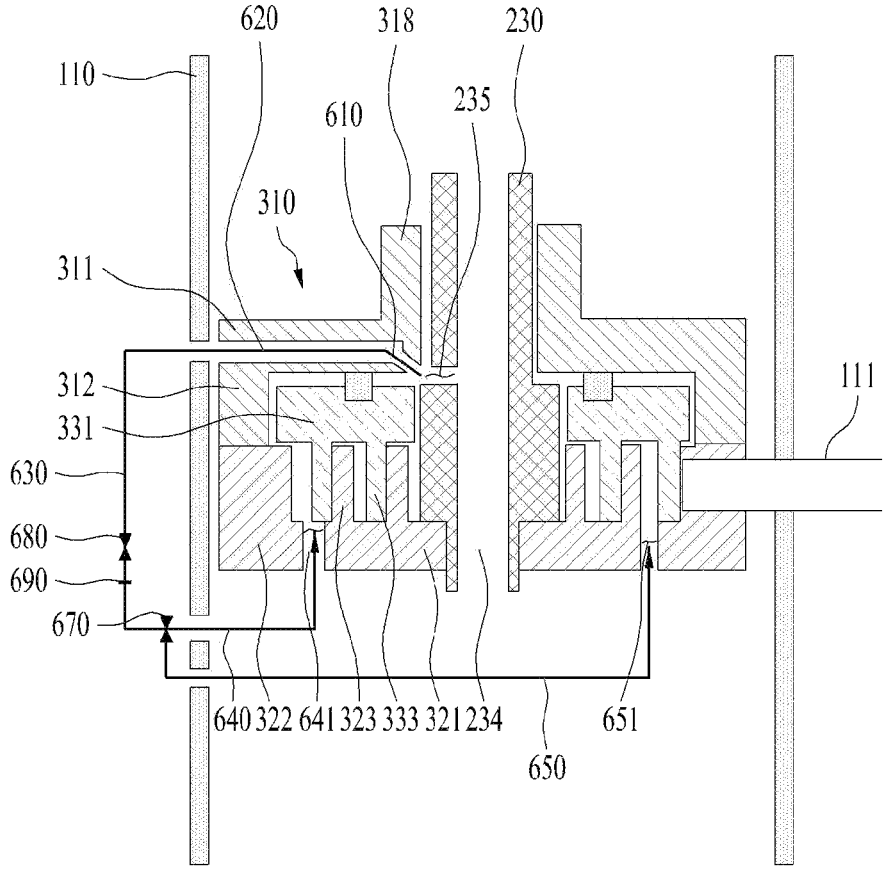
FIG. 8 is a view showing a first branched passage, a flow rate adjusting valve, a pressure sensor, and passage adjusting portion according to an embodiment of the present disclosure.

FIG. 8 is a view showing a first branched passage, a flow rate adjusting valve, a pressure sensor, and passage adjusting portion according to an embodiment of the present disclosure.

Hereinafter, FIG. 8 will be described. A description of the content duplicate with the content described in FIGS. 3 and 5 will be omitted. However, not all of the same contents as those described above are omitted, and some may be described again for convenience of description and clear understanding of the invention. In addition, omissions should not be excluded or interpreted independently.

The compressor 10 according to the present embodiment may include the passage adjusting portion 670, the flow rate adjusting valve 680, and the pressure sensor 690.

Specifically, the flow rate adjusting valve 680 and the pressure sensor 690 may be disposed forwardly of a portion branching from the main passage 640 to the first branched passage 650. Accordingly, a pressure of an entire passage through which the oil flows may be measured and an oil flow rate of the entire passage through which the oil flows may be adjusted.

When the oil flows into the third passage 630 or the main passage 640 by the passage adjusting portion 670, the opening and closing rate of the flow rate adjusting valve 680 may be adjusted based on the amount of oil flowing into the third passage 630 or the main passage 640.

In addition, when the oil flows into the third passage 630 or the first branched passage 650 by the passage adjusting portion 670, the opening and closing rate of the flow rate adjusting valve 680 may be adjusted based on the amount of oil flowing into the third passage 630 or the first branched passage 650.

The pressure sensor 690 may be in communication with the third passage 630 or the main passage 640.

When the oil flows into the third passage 630 or the main passage 640 by the passage adjusting portion 670, the pressure sensor 690 may measure the pressure of the third passage 630 or the main passage 640.

In addition, when the oil flows into the third passage 630 or the first branched passage 650 by the passage adjusting portion 670, the pressure sensor 690 may measure the pressure of the third passage 630 or the first branched passage 650.

When the oil flows to the main passage 640 via the third passage 630, even when the clogging phenomenon occurs at a rear end of the main passage 640, the oil may flow to the first branched passage 650 by the passage adjusting portion 670, so that the oil may be continuously supplied.

In addition, when the oil flows to the first branched passage 650 via the third passage 630, even when the clogging phenomenon occurs at a rear end of the first branched passage 650, the oil may flow to the main passage 640 by the passage adjusting portion 670, so that the oil may be continuously supplied.

Accordingly, even when the passage clogging phenomenon occurs, the passage clogging phenomenon may be solved by the passage adjustment of the passage adjusting portion 670. Accordingly, the reliability of the oil supply of the compressor 10 may be secured.

Figure 9:
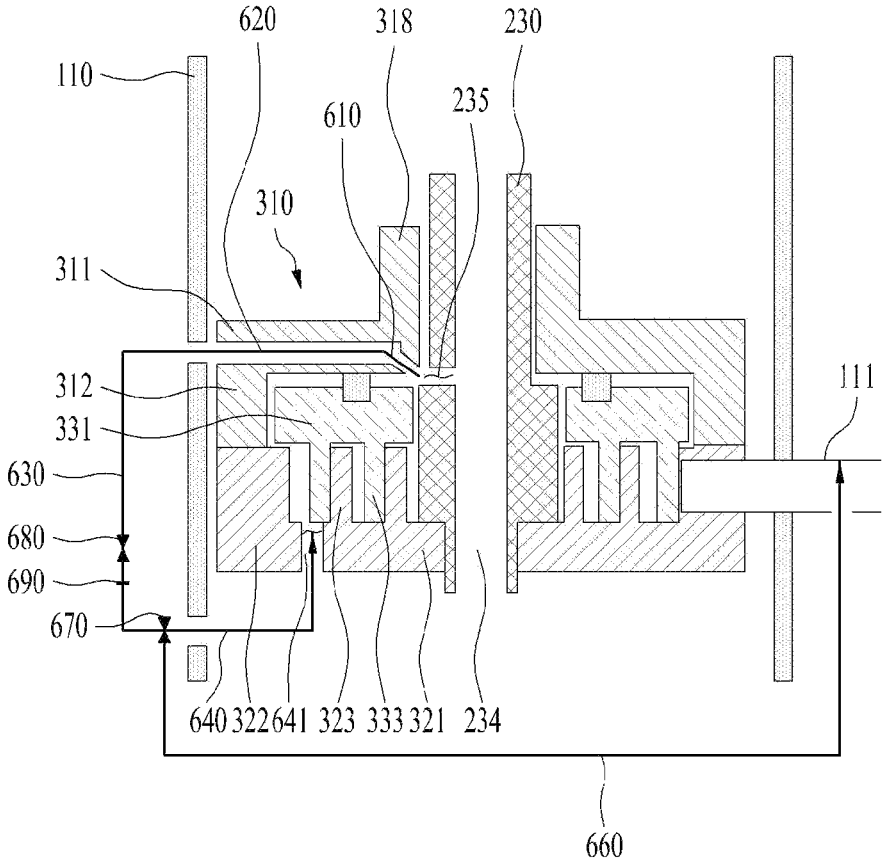
FIG. 9 is a view showing a second branched passage, a flow rate adjusting valve, a pressure sensor, and passage adjusting portion according to an embodiment of the present disclosure.

FIG. 9 is a view showing a second branched passage, a flow rate adjusting valve, a pressure sensor, and a passage adjusting portion according to an embodiment of the present disclosure.

Hereinafter, FIG. 9 will be described. A description of the content duplicate with the content described in FIGS. 4 and 6 will be omitted. However, not all of the same contents as those described above are omitted, and some may be described again for convenience of description and clear understanding of the invention. In addition, omissions should not be excluded or interpreted independently.

The compressor 10 according to the present embodiment may include the passage adjusting portion 670, the flow rate adjusting valve 680, and the pressure sensor 690.

The flow rate adjusting valve 680 and the pressure sensor 690 may be disposed forwardly of a portion branching from the main passage 640 to the second branched passage 660. Accordingly, the pressure of the entire passage through which the oil flows may be measured and the oil flow rate of the entire passage through which the oil flows may be adjusted.

When the oil flows into the third passage 630 or the main passage 640 by the passage adjusting portion 670, the opening and closing rate of the flow rate adjusting valve 680 may be adjusted based on the amount of oil flowing into the third passage 630 or the main passage 640.

In addition, when the oil flows into the third passage 630 or the first branched passage 650 by the passage adjusting portion 670, the opening and closing rate of the flow rate adjusting valve 680 may be adjusted based on the amount of oil flowing into the third passage 630 or the first branched passage 650.

The pressure sensor 690 may be in communication with the third passage 630 or the main passage 640.

When the oil flows into the third passage 630 or the main passage 640 by the passage adjusting portion 670, the pressure sensor 690 may measure the pressure of the third passage 630 or the main passage 640.

In addition, when the oil flows into the third passage 630 or the second branched passage 660 by the passage adjusting portion 670, the pressure sensor 690 may measure the pressure of the third passage 630 or the second branched passage 660.

When the oil flows to the main passage 640 via the third passage 630, even when the clogging phenomenon occurs at the rear end of the main passage 640, the oil may flow to the second branched passage 660 by the passage adjusting portion 670, so that the oil may be continuously supplied.

In addition, when the oil flows to the second branched passage 660 via the third passage 630, even when the clogging phenomenon occurs at a rear end of the second branched passage 660, the oil may flow to the main passage 640 by the passage adjusting portion 670, so that the oil may be continuously supplied.

Accordingly, even when the passage clogging phenomenon occurs, the passage clogging phenomenon may be solved by the passage adjustment of the passage adjusting portion 670. Accordingly, the reliability of the oil supply of the compressor 10 may be secured.

Although representative embodiments of the present disclosure have been described in detail above, those with ordinary skill in the technical field to which the present disclosure belongs will understand that various modifications are possible with respect to the above-described embodiments without departing from the scope of the present disclosure. Therefore, the scope of rights of the present disclosure should not be limited to the described embodiments and should be defined by the claims to be described later as well as equivalents thereof.

The invention claimed is:

1. A compressor comprising:

a casing defining (i) a suction port configured to introduce refrigerant into the compressor, (ii) a discharge port configured to discharge the refrigerant, and (iii) an oil storage space configured to store oil;

a driver coupled to an inner circumferential surface of the casing;

a rotating shaft coupled to the driver and including:

an oil feeder configured to collect the oil stored in the oil storage space, and an oil supply passage connected to the oil feeder and extending in a direction away from the oil storage space, the oil supply passage being configured to allow the oil collected by the oil feeder to flow;

a compressing portion including:

an orbiting scroll configured to receive the oil from the oil supply passage, the orbiting scroll being coupled to the rotating shaft and configured to orbit based on the rotating shaft rotating, a fixed scroll engaging the orbiting scroll and configured to receive the refrigerant from the suction port to compress and discharge the refrigerant, wherein the oil feeder extends through the fixed scroll, and a main frame seated at the fixed scroll and configured to accommodate the orbiting scroll, wherein the rotating shaft extends through the main frame;

a first passage disposed at the main frame and being in communication with the oil supply passage to thereby receive the oil from the oil supply passage;

a second passage extending from the first passage toward an outside of the casing and configured to enable the oil to flow the outside of the casing;

a third passage extending from the second passage and disposed at the outside of the casing; and a main passage extending from the third passage and extending through the fixed scroll or the main frame, wherein the main frame includes:

a main end plate receiving the rotating shaft therethrough and configured to accommodate the orbiting scroll, and a main side plate extending from the main end plate and connected to the fixed scroll, wherein the fixed scroll includes:

a fixed end plate coupled to the casing at a location opposite to the driver with respect to the main end plate, a fixed side plate extending from the fixed end plate toward the discharge port and contacting the main side plate, and a fixed wrap positioned closer to the rotating shaft than the fixed side plate and protruding toward the discharge port from the fixed end plate, wherein the fixed wrap defines a compression chamber configured to compress the refrigerant, and wherein one of the main side plate, the fixed end plate, or the fixed side plate defines a first inflow portion configured to supply the oil to a space between the fixed scroll and the orbiting scroll from the main passage.

2. The compressor of claim 1, further comprising:

a second inflow portion positioned farther from the rotating shaft than the first inflow portion and extending through one of the main side plate, the fixed end plate, and the fixed side plate; and a first branched passage branched from the main passage and configured to supply the oil to the space between the fixed scroll and the orbiting scroll via the second inflow portion.

3. The compressor of claim 2, wherein the first inflow portion and the second inflow portion are disposed at opposite sides with respect to the rotating shaft.

4. The compressor of claim 1, further comprising:

a second branched passage branched from the main passage and configured to supply the oil to the suction port, the suction port being located farther from the rotating shaft than the first inflow portion is.

5. The compressor of claim 2, further comprising:

a passage adjusting portion disposed at a portion that branches from the main passage to the first branched passage, the passage adjusting portion being configured to, based on an operating pressure, change a flow of the oil to either the main passage or the first branched passage.

6. The compressor of claim 5, wherein the passage adjusting portion is disposed at the outside of the casing.

7. The compressor of claim 5, wherein the passage adjusting portion is configured to allow the oil to flow to the main passage based on the operating pressure being equal to or higher than a reference value and to allow the oil to flow to the first branched passage based on the operating pressure being lower than the reference value.

8. The compressor of claim 5, wherein the passage adjusting portion includes as a three-way valve.

9. The compressor of claim 4, further comprising:

a passage adjusting portion disposed at a portion that branches from the main passage to the second branched passage, the passage adjusting portion being configured to, based on an operating pressure, change a flow of the oil to either the main passage or the second branched passage.

10. The compressor of claim 9, wherein the passage adjusting portion is disposed at the outside of the casing.

11. The compressor of claim 9, wherein the passage adjusting portion is configured to allow the oil to flow to the main passage based on the operating pressure being equal to or higher than a reference value and to allow the oil to flow to the second branched passage based on the operating pressure being lower than the reference value.

12. The compressor of claim 9, wherein the passage adjusting portion includes as a three-way valve.

13. The compressor of claim 1, wherein the second passage extends through the main frame and the casing.

14. The compressor of claim 1, further comprising:

a flow rate adjusting valve disposed at the third passage or the main passage, wherein an opening and closing rate of the flow rate adjusting valve is adjusted based on an amount of oil flowing into the third passage or the main passage.

15. The compressor of claim 14, further comprising:

a pressure sensor located at a rear end of the flow rate adjusting valve and being in communication with the third passage or the main passage, the pressure sensor being configured to measure a pressure of the third passage or the main passage.

16. The compressor of claim 14, wherein the flow rate adjusting valve is disposed at the outside of the casing.

17. The compressor of claim 15, wherein the pressure sensor is disposed at the outside of the casing.

18. A compressor comprising:

an orbiting scroll configured to orbit;

a fixed scroll engaging the orbiting scroll and configured to receive refrigerant to compress the refrigerant;

a main frame seated at the fixed scroll and configured to accommodate the orbiting scroll;

a first passage disposed at the main frame and configured to receive oil;

a second passage extending from the first passage toward an outside of a casing of the compressor and configured to enable the oil to flow the outside of the casing;

a third passage extending from the second passage and disposed at the outside of the casing; and a main passage extending from the third passage and extending through the fixed scroll or the main frame, wherein the main frame includes:

a main end plate receiving a rotating shaft therethrough and configured to accommodate the orbiting scroll, and a main side plate extending from the main end plate and connected to the fixed scroll, wherein the fixed scroll includes:

a fixed end plate coupled to the casing, a fixed side plate extending from the fixed end plate and contacting the main side plate, and a fixed wrap positioned closer to the rotating shaft than the fixed side plate and defining a compression chamber configured to compress the refrigerant, and wherein one of the main side plate, the fixed end plate, or the fixed side plate defines a first inflow portion configured to supply the oil to a space between the fixed scroll and the orbiting scroll from the main passage.

* * * * *